US006039638A

United States Patent [19]

Nagayama et al.

[11] Patent Number: 6,039,638

[45] Date of Patent: Mar. 21, 2000

[54] WORK PLANARIZING METHOD AND APPARATUS

[75] Inventors: Hitoshi Nagayama; Motoi Nezu, both of Ayase, Japan

[73] Assignee: Speedfam Co., Ltd., Tokyo, Japan

[21] Appl. No.: 09/017,010

[22] Filed: Feb. 2, 1998

[30] Foreign Application Priority Data

Feb. 6, 1997 [JP] Japan ..... 9-038429

[51] Int. Cl.[7] ..... B24B 5/00

[52] U.S. Cl. ..... 451/288

[58] Field of Search ..... 451/287, 288, 451/398

[56] References Cited

U.S. PATENT DOCUMENTS

| | | | |
|---|---|---|---|
| 4,918,869 | 4/1990 | Kiha | 51/131.1 |
| 5,191,738 | 3/1993 | Nakazato et al. | 51/283 R |
| 5,193,316 | 3/1993 | Olmstead | 51/281 |
| 5,216,843 | 6/1993 | Breivogel et al. | 51/131.1 |
| 5,377,451 | 1/1995 | Leoni et al. | 451/287 |
| 5,476,414 | 12/1995 | Hirose et al. | 451/288 |
| 5,554,065 | 9/1996 | Clover | 451/283 |
| 5,584,750 | 12/1996 | Ishida et al. | 451/288 |
| 5,588,902 | 12/1996 | Tominaga et al. | 451/288 |
| 5,595,527 | 1/1997 | Appel et al. | 451/28 |

FOREIGN PATENT DOCUMENTS

| | | |
|---|---|---|
| 64-2857 | 1/1989 | Japan . |
| 5-69310 | 3/1993 | Japan . |
| 7-124862 | 5/1995 | Japan . |
| 7-41534 | 5/1995 | Japan . |

*Primary Examiner*—Joseph J. Hail, III
*Assistant Examiner*—Dermott J. Cooke
*Attorney, Agent, or Firm*—Michael K. Kelly; Snell & Wilmer L.L.P.

[57] ABSTRACT

A method and apparatus for planarizing works can adjust an urging force or pressure applied to a work with ease in a short period of time, but also avoid wasteful use of rings. Wafers 100 adhered to a block 110 is made into contact with a lower surface plate 1. An annular ring 5 which encloses the wafers 100 is disposed in the peripheral portion of the block 110. The peripheral portion of the block 110 is pressed by a head 4 through an annular ring 5. Simultaneous with this, by rotating the lower surface plate 1 while pressing the central portion of the block 110 at a desired pressure by means of a center-pressing member 6 provided on the head 4, the wafers 100 are planarized. Preferably, the center-pressing member 6 includes a pressure chamber 7 formed in the central portion of the head 4, a pressing plate 8 mounted in an opening of the pressure chamber 7 for movement relative thereto so that it can project from the opening to thereby press the central portion of the block 110, and an air pump 9 for controlling the air pressure in the pressure chamber 7.

16 Claims, 7 Drawing Sheets

WORK PLANARIZING METHOD AND APPARATUS

BACKGROUND OF THE INVENTION

1. Field of the Invention

This invention relates to a method and an apparatus for planarizing or flattening a surface of a work.

2. Description of the Related Art

In a one-side surface lapping apparatus, a block 110 having wafers attached thereto is pressed against a lower surface plate 300 while being held by a head 200 so that the surfaces of the wafers 100 are lapped or planarized by the lower surface plate 300 which is driven to rotate.

With such a one-side surface lapping apparatus, however, an urging force or pressure of the head 200 is not always applied to the wafers 100 in a uniform manner, but sometimes localized.

As a consequence, the lapping or planarizing rate of each wafer 100 is varied at respective portions of the surface thereof so that the surface of each wafer 100 may not be flattened or planarized to any satisfactory extent.

Thus, the technique of flattening or planarizing the surface of each wafer 100 is conventionally applied to a one-side surface lapping apparatus or the like.

FIGS. 11(*a*) through 11(*c*) are schematic cross sections showing a conventional wafer planarizing technique. This technique is to adjust the distribution of the urging force or pressure applied to each wafer 100 by use of a ring.

Specifically, as shown in FIG. 11(*a*), an annular ring 210 is attached to the lower surface of the head 200, and a block 110 is mounted on a lower side of the ring 210. Thus, the urging force applied to the block 110 is the greatest at the annular ring 210. Therefore, the distribution of the urging force applied to the wafer 100 can be made substantially uniform by adjusting or changing the diameter of the annular ring 210.

Speaking concretely, in the case where the radially inner portion of the wafer 100 is lapped or planarized more than the radially outer portion thereof by the use of a small-diameter annular ring 210, as shown in FIG. 11(*a*), another annular ring 210 having a larger diameter is prepared and used in place of the small-diameter ring. In this case, however, if the radially outer portion of the wafer 100 is lapped or planarized more than the radially inner portion thereof, as shown in FIG. 11(*b*), a further annular ring 210 having a diameter slightly smaller than that ring is prepared and installed. Such a trial-and-error process is repeated to find a just-fit ring of an exact diameter.

In this manner, if an annular ring 210 of such a size as to allow a substantially equal partial pressure to be applied to the entire surface of the wafer 100 is prepared and installed, the surface of the wafer 100 can be planarized or flattened in a uniform manner, as shown in FIG. 11(*c*).

However, the above-mentioned conventional technique has the following problems.

In order to make uniform the urging force applied to the wafer 100, it is necessary to prepare an annular ring 210 of a suitable diameter and mount it to the lower surface of the head 200 in such a manner that the center of the annular ring 210 is accurately in coincidence with the center of the lower surface of the head 200. It is lucky if such operations (i.e., preparation and mounting of such a ring) are required and finished only once or just few times, but in general it is necessary to actually attach many annular rings 210 of varying sizes to the head 200 and detach them therefrom repeatedly a number of times by the time when an appropriate annular ring 210 of a just-fit diameter is found, Thus, these troublesome operations have to be conducted repeatedly for a relatively long period of time. Moreover, once the annular ring 210 attached or adhered to the head 200 is detached or peeled off, it can not be reused.

Thus, the annular ring 210 elaborated with much trouble cannot be reused for the subsequent adjustment work, and become useless.

SUMMARY OF THE INVENTION

In view of the above, the present invention is intended to obviate the above-described problem, and has for its object to provide a work planarizing method and apparatus of the character as described in which pressure adjustment for works can be carried out in an easy and simple manner in a short time, and in which wasteful use of rings can be avoided for cost reduction.

According to one aspect of the present invention, there is provided a work planarizing method comprising the steps of: contacting works attached to a first surface of a planar block to a surface plate; disposing a ring substantially enclosing the works in a peripheral portion of a second surface of the block; pressing the second surface peripheral portion of the block by means of a pressure member through the ring; and planarizing the surfaces of the works by rotating the surface plate while pressing the second surface central portion of the block at a desired pressure by means of a pressure-adjustable center-pressing means mounted on the pressure member.

With this construction, the peripheral portion of the block is pressed or pushed by the ring which encloses the works, and the central portion of the block is pressed or pushed by the center-pressing means, so that the pressing or urging force of the center-pressing means can be adjusted to change the distribution of the pressing force applied to the works through the block.

According to another aspect of the present invention, there is provided a work planarizing apparatus comprising: a surface plate adapted to rotate for planarizing works; a pressure member for holding a planar block having the works attached to a first surface thereof so as to press the works toward the surface plate; a ring provided in a peripheral portion of a second surface of the block so as to substantially enclose the works from its second surface; and pressure-adjustable center-pressing means provided on the pressure member for pressing a central portion of the second surface of the block at a desired pressure.

With this construction, when the works are pressed against the surface plate side by the pressure member, the peripheral portion of the block is pressed by the ring. At this time, pressing the central portion of the block by a desired force can render the distribution of the force applied to the works into a desired state of distribution.

In a preferred form of the invention, the center-pressing means comprises: a pressure chamber defined in the pressure member at a central portion of a surface thereof; a pressing member received in an opening of the pressure chamber so as to be movable into or out of the opening so that it can project from the opening of the pressure chamber to thereby press a central portion of the second surface of the block; and a pressure control member for controlling a pressure of fluid in the pressure chamber.

In another preferred form of the invention, the fluid is air.

In a further preferred form of the invention, the center-pressing means comprises: a spring-receiving chamber which opens substantially at a central portion of the first surface of the pressure member; a spring-end support member provided in the spring-receiving chamber so as to be movable therein to adjust an amount of depth of the spring-receiving chamber; and a pressing member disposed at the opening of the spring-receiving chamber in such a manner as to move in or out of the opening; a spring member for biasing the pressing member to project from the opening.

In a yet further preferred form of the invention, the center-pressing means comprises: a female screw portion disposed substantially at the central portion of the pressure member; and a male screw portion threaded into the female screw portion so as to project from the female screw portion for pressing the second surface central portion of the block.

The above and other objects, features and advantages of the present invention will become more readily apparent to those skilled in the art from the following detailed description of the invention taken in conjunction with the accompanying drawings.

DESCRIPTION OF THE PREFERRED EMBODIMENTS

In the following, preferred embodiments of the present invention will be described in detail while referring to the accompanying drawings.

The First Embodiment

Figure 1:
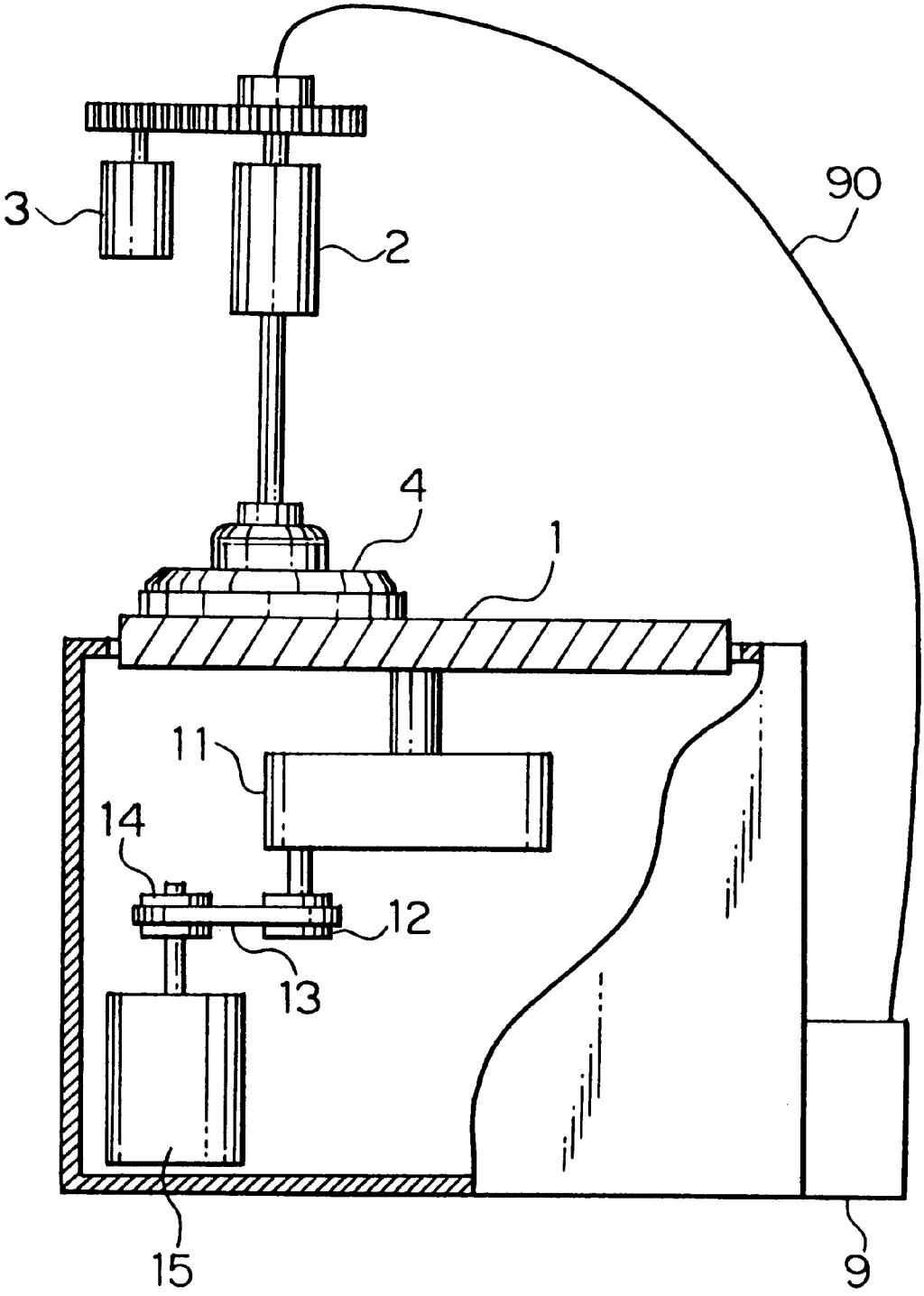
FIG. 1 is a front elevation showing in a partially broken manner a part of a one-side surface lapping apparatus applied to a first embodiment of the present invention.

FIG. 1 is a front elevation showing, in a partially broken-away manner, a one-side surface lapping apparatus applied to a first embodiment of the present invention.

This one-side surface lapping apparatus includes a lower surface plate 1, a vertical driving device 2, a motor 3 and a pressure member in the form of a head 4 attached to a lower end of the lower surface plate 1, as shown in FIG. 1. The head 4 presses or pushes works in the form of wafers 100 against the lower surface plate 1 while rotating the wafers 100 under the actions of the vertical driving device 2 and the motor 3.

Figure 2:
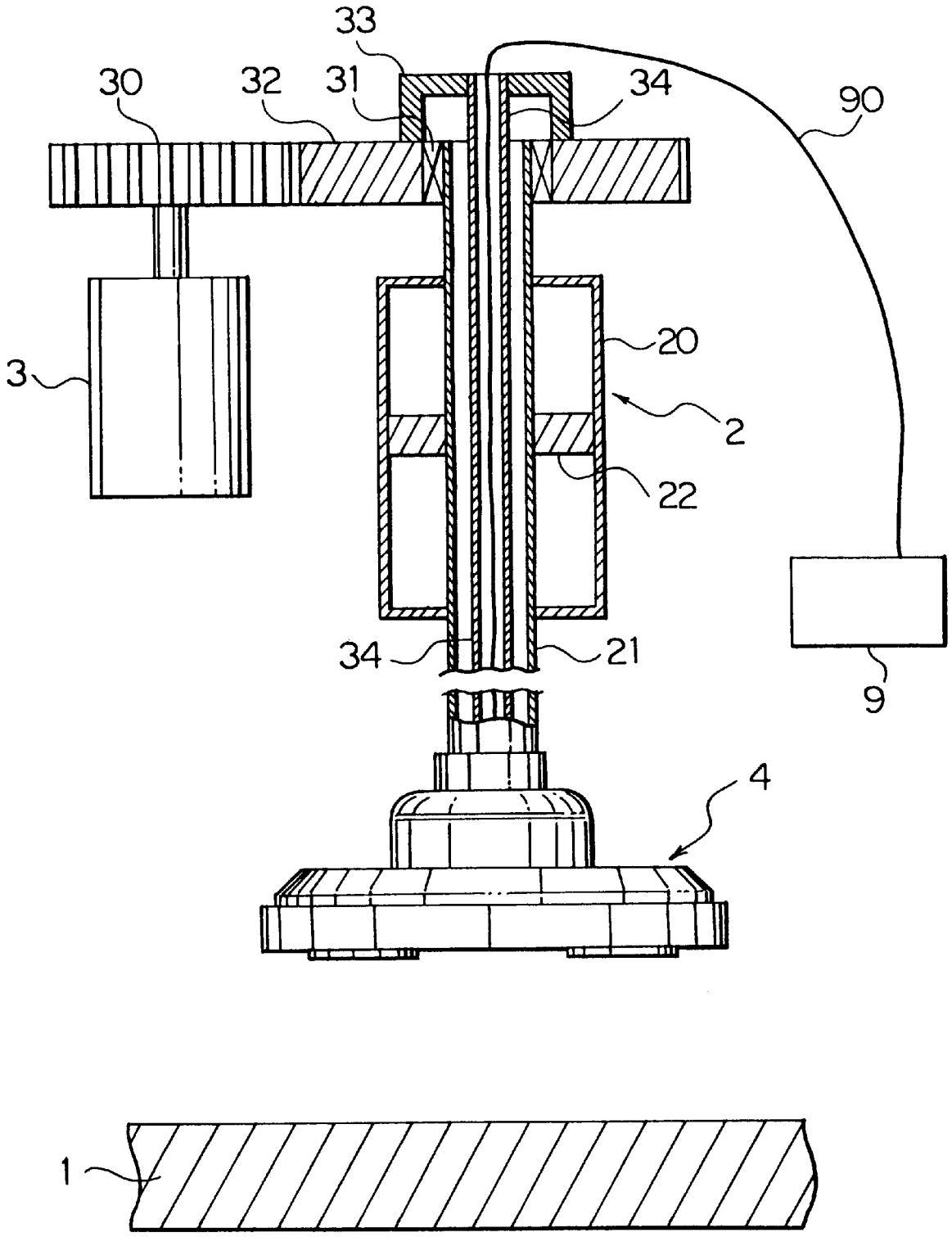
FIG. 2 is a sectional view showing a rotation mechanism comprising a vertically driving device and a motor.

FIG. 2 shows in cross section a rotation mechanism comprising the vertical driving device 2 and the motor 3.

The vertical driving device 2 comprises a cylinder 20, a cylindrical piston rod 21 extending vertically through the cylinder 20, and a piston 22 which is fixedly secured to the outside portion of the piston rod 21 and sealingly fitted in the cylinder 20 for sliding movement relative thereto.

An operating medium or fluid such as air is supplied to or discharged from the cylinder 20 through an unillustrated hose whereby the piston 22 is caused to move in a vertical direction.

The motor 3 fixedly mounted on an unillustrated support is operatively connected with the piston rod 21 of the vertical driving device 2.

Specifically, a drive gear 30 fixedly secured to the rotation shaft of the motor 3 is in meshing engagement with a driven gear 32 which is rotatably mounted on an upper part of the piston rod 21 through a bearing 31.

A cylindrical inner rod 34 being inserted in and extending through the cylindrical piston rod 21 is fixedly coupled at its top end to a cap-shaped support member 33 which is provided on and firmly connected with the upper surface of the driven gear 32.

The head 4 is connected with the vertical driving device 2 and the motor 3 as constructed above.

Figure 3:
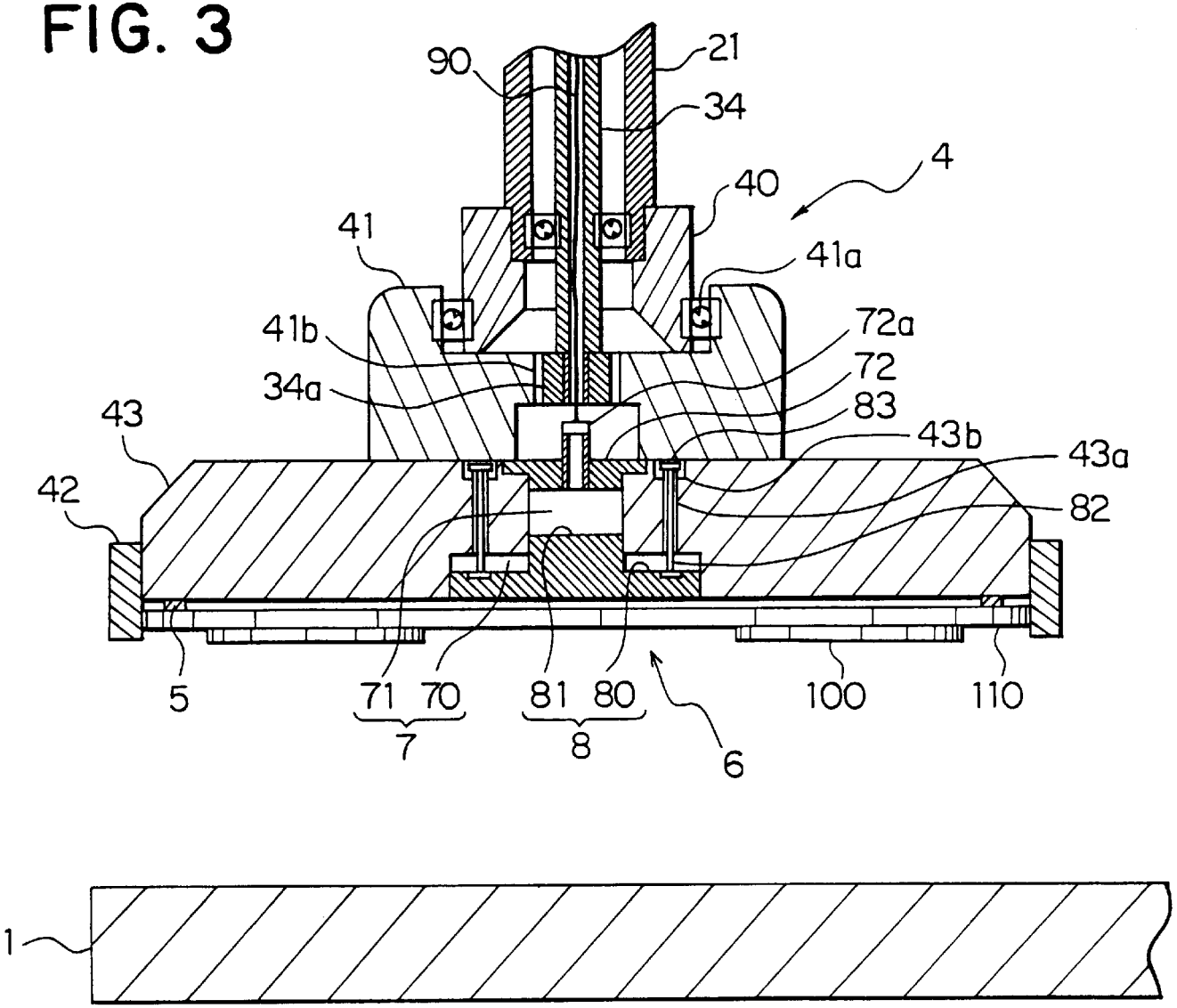
FIG. 3 is a sectional view of a head.

FIG. 3 is a sectional view of the head 4.

As shown in FIG. 3, the head 4 comprises a housing 40 fixed to a lower end of the piston rod 21 of the vertical driving device 2, an internally toothed gear member 41 which is rotatably connected with the housing 40 through a bearing 41*a* and which has an internal tooth 41*b* in meshing engagement with a gear B4 fixedly mounted on a lower end of the inner rod 34, and a pressure plate 43 firmly attached to the internally toothed gear member 41 and having a retainer ring 42 secured to the outer peripheral surface thereof.

With this construction, when the vertical driving device 2 shown in FIG. 2 is actuated, the head 4 connected with the piston rod 21 is caused to move in a vertical direction.

Subsequently, when the motor 3 is energized, the inner rod 34 is driven to rotate by means of the motor 3 through the intermediary of the motor rotation shaft, the drive gear 30, the driven gear 31, and the cap-shaped support member 33. The rotation of the inner rod 34 is then transmitted to the internally toothed gear member 41 through.

As a result, the internally toothed gear member 41 and the pressure plate 43 rotate integrally around the housing 40 under the action of the bearing 41*a*.

A pressure adjustment mechanism is incorporated in the head 4. As shown in FIG. 3, the pressure adjustment mechanism includes an annular ring 5 attached or adhered to the lower surface of pressure plate 43 and a center-pressing means 6. The annular ring 5 is fixedly attached to a lower surface peripheral portion of the pressure plate 43.

Figure 4:
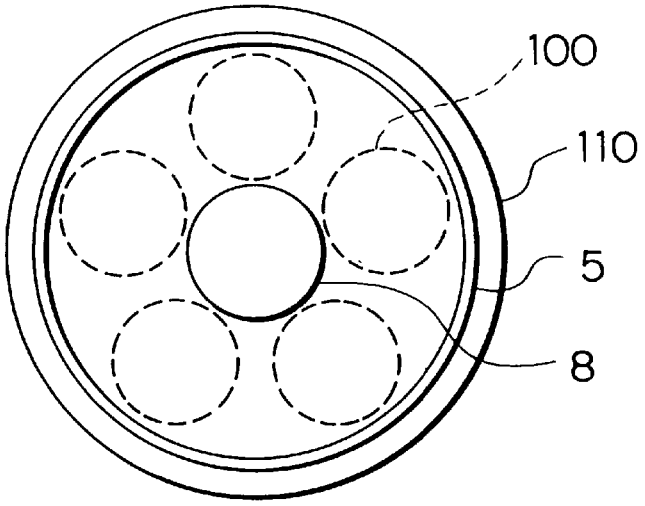
FIG. 4 is a plan view showing the pressing positions of a ring and a center-pressing plate against a block.

Specifically, the annular ring 5 is designed in such a size as to substantially enclose the plurality of wafers 100 attached to the block 110 from the upper surface side thereof, as shown in FIG. 4. Thus, the annular ring 5, when receiving the urging force or thrust of the pressure plate 43, acts to press the peripheral portions of the plurality of wafers 100.

On the other hand, the center-pressing means 6 serves to press or push the central portion of the upper surface of the block 110 at a desired pressure, as shown in FIG. 3.

The center-pressing means 6 comprises a pressure chamber 7 recessed in the lower surface of the pressure plate 43, a pressing member in the form of a pressing plate 8 fitted in the pressure chamber 7, and a pressure control means in the form of an air pump 9 (see FIGS. 1 and 2) for controlling the pressure of air in the pressure chamber 7.

The pressure chamber 7 includes a large-diameter portion formed in the pressure plate 43 opening at the lower surface of the pressure plate 43 for fitting therein the pressing plate 8, and a small-diameter portion 71 in communication with the large-diameter portion 70 for filling air therein.

Figure 5:
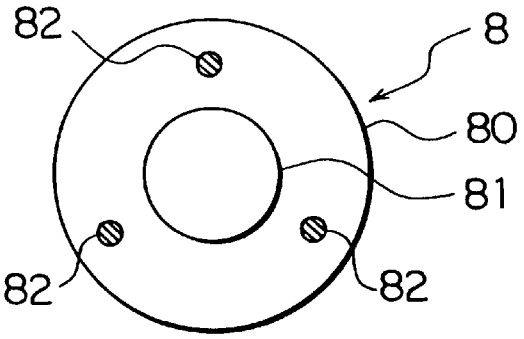
FIG. 5 is a plan view of the center-pressing plate.

The center-pressing plate 8 has a block-pressing portion 80 having a diameter substantially equal to the large-diameter portion 70 of the pressure chamber 7, and a pressure-receiving portion 81 having a diameter substantially equal to the small-diameter portion 71, as shown in FIG. 5. The block pressing-portion 80 and the pressure-receiving portion 81 are airtightly fitted in the large-diameter portion 70 and the small-diameter portion 71, respectively.

Moreover, the center-pressing plate 8 is received in the pressure chamber 7 so as to be movable into or out of the pressure chamber 7.

Specifically, a plurality of (e.g., three in the illustrated embodiment) guide rods 82 are vertically mounted on the upper surface of the block-pressing portion 80 and spaced from each other at intervals of 120 degrees in the lateral or horizontal direction. These guide rods 82 are each inserted into a corresponding rod hole 43*a* which penetrates through the pressure plate 43 from the large-diameter portion 70 to the upper surface of the pressure plate 43.

A plurality of loose holes 43*b* each having an enlarged diameter and a predetermined depth are formed in the pressure plate 43 at the upper part of each rod hole 43*a*, so that a stopper 83 fixedly attached to the top of each guide rod 82 is engageable with the bottom of the loose hole 43*b*.

With this arrangement, as the center-pressing plate 8 is moved vertically, the guide rods 82 are caused to move up and down in the rod holes 43*a*, and the stoppers 83 are each brought into engagement with the bottom of a corresponding loose hole 43*b*, thereby restricting the amount of projection of the center-pressing plate 8 from the lower surface of t he pressure plate 43.

Thus, the center-pressing plate 8 can press the radially inner portion of each of the plurality of wafers 100 from the upper surface of the block 110, as shown in FIG. 4.

The air pump 9 serves to move the center-pressing plate 8 into or out of the pressure chamber 7 by controlling the pressure in the pressure chamber 7.

Specifically, as shown in FIG. 2, a tube 90 extending from the air pump 9 is inserted into the inner rod 34 from its upper opening. The tube 90 is connected at its one end with a connector 72*a* which is fitted into a central bore of a sealing member 72 airtightly mounted to the pressure plate 43 at an upper portion of the pressure chamber 7. Thus, air from the air pump 9 flows in or out of the pressure chamber 7 through the tube 90 and the connector 72*a* so as to change the air pressure in the pressure chamber 7.

Figure 6A:
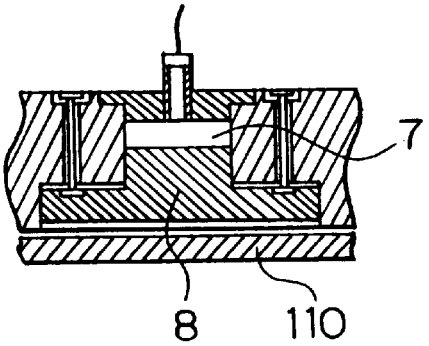
FIGS. 6(*a*) and 6(*b*) are cross sectional views showing the state of movement of the center-pressing plate at its different positions.
Figure 6B:
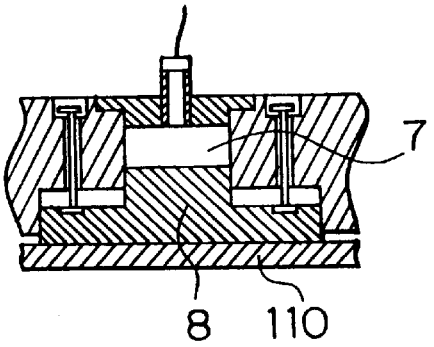

As shown in FIG. 6(*a*), when the air pump 9 is energized to rotate in a reverse direction so as to evacuate the pressure chamber 7, the center-pressing plate 8 is drawn or sucked into the pressure chamber 7.

On the other hand, as shown in FIG. 6(*b*), by making the pressure in the pressure chamber 7 a positive pressure through a forward rotation of the air pump 9, the center-pressing plate 8 is caused to project from or move out of the pressure chamber 7 to thereby press the central portion of the upper surface of the block 110.

Accordingly, by controlling the air pressure in the pressure chamber 7 by means of the air pump 9, it is possible to adjust the urging or pressing force which is applied to the central portion of the block 110 by the center-pressing plate 8.

Next, the operation of the one-side surface lapping apparatus of this embodiment will be explained below.

It is to be noted that the operation of the one-side surface lapping apparatus concretely achieves a work planarizing method of the present invention.

First, as shown in FIG. 3, the block 110 having the plurality of wafers 100 attached to the lower surface thereof is mounted to the lower surface of the head 4 to which the annular ring 5 is adhered, and then the head 4 is driven to move downwardly toward the lower surface plate 1 by means of the vertical driving device 2, as shown in FIG. 2.

Thus, the block 110 is pressurized or urged to press the wafer 100 toward the lower surface plate 1 by means of the head 4. In this state, when the motors 3 and 15 (see FIG. 1) are energized to rotate the head 4 and the lower surface plate 1, the lower surfaces of the wafers 100 are planarized by the lower surface plate 1.

Here, it is to be noted that the annular ring 5 is interposed between the pressure plate 43 of the head 4 and the block 110.

The annular ring 5 is in a state to enclose the plurality of wafers 100 from their outside as previously referred to, so that the pressing or urging force from the head 4 concentrates on the annular ring 5. As a consequence, the urging force applied from the head 4 to the block 110 is distributed in such a manner as shown in FIG. 7(*a*).

Figure 7A:
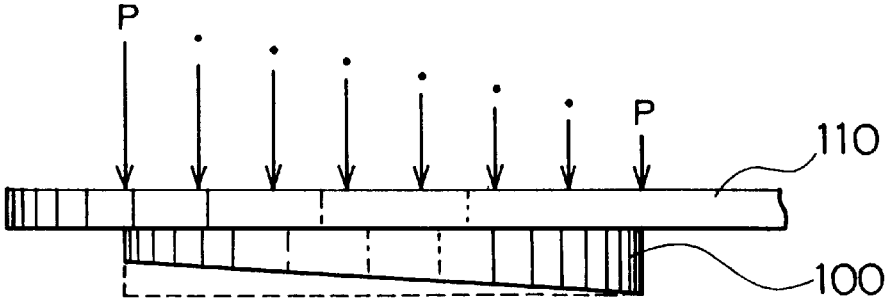
FIGS. 7(*a*) and (*b*) are schematic side views respectively showing the distributions of non-uniform and uniform pressing forces.
Figure 7B:
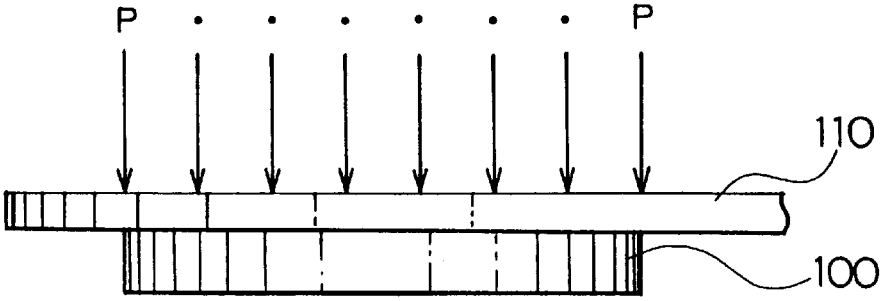

Namely, the urging force or pressure P becomes the greatest on the outer peripheral portion of each wafer 100 (i.e., the left-hand side in FIG. 7(*a*)) and decreases from the outer periphery thereof toward the inner periphery thereof, so when the wafers 100 are lapped or planarized in such a state, each wafer 100 will be lapped or planarized greater on the outer peripheral portion thereof than on the inner peripheral portion thereof, thus making it impossible to flatten or planarize the lower surface of each wafer 100, as indicated by the solid line in FIG. 7(*a*).

Thus, the distribution of the urging force or pressure P is made uniform by using the center-pressing means 6 shown in FIG. 3. That is, the air pump 9 is operated to supply pressure air to the pressure chamber 7 so as to make the air pressure therein to be positive, whereby the center-pressing plate 8 is forced to project from the pressure chamber 7, thus applying a new urging force to the central portion of the block 110, as shown in FIG. 6(*b*).

As a result, each wafer 100 is pressed or pushed at its outer peripheral portion by the annular ring 5, and at its inner peripheral portion by the center-pressing plate 8, so irregularities in the distribution of the urging force or pressure P is corrected.

Therefore, by controlling the air pressure in the pressure chamber 7 by means of the air pump 9 so as to adjust the urging force applied to the central portion of the block 110 by the center-pressing plate 8, the distribution of the urging force P can be made substantially uniform, as illustrated in FIG. 7(*b*).

By lapping the wafers 100 in such a state, the lower surfaces of the wafers 100 are flattened or planarized, as shown in FIG. 7(*b*).

As described above, according to the one-side surface lapping apparatus of this embodiment, the urging force applied to the wafers 100 can be automatically adjusted by the center-pressing means 6, so that the operations of detaching the used annular ring 5 and preparing a new one are not required. As a result, a pressure-adjusting operation can be conducted with easy in a short period of time.

Moreover, since the annular ring 5 can repeatedly be used almost permanently, the wastefulness in throwing away once-used rings can be avoided.

In addition, fine control of the urging force or pressure can be made by setting the upper surface area of the pressure-receiving portion 81 of the center-pressing plate 8 to a small value.

The Second Embodiment

Figure 8:
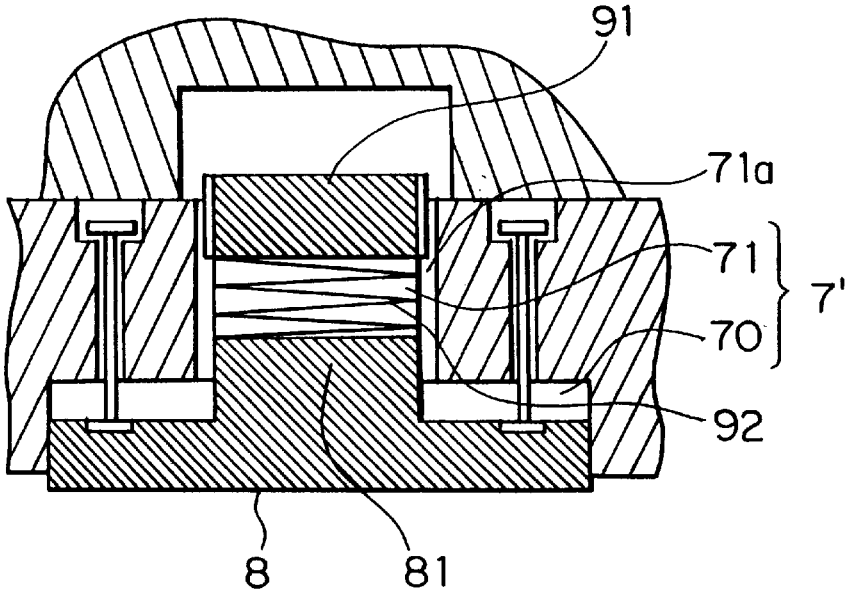
FIG. 8 is a sectional view showing essential parts of a second embodiment of the present invention.

FIG. 8 shows in cross section essential parts of a second embodiment of the present invention.

This embodiment differs from the above-mentioned first embodiment in that the pressure chamber 7 of the above-mentioned first embodiment is utilized as a spring-receiving chamber 71 for spring biasing the center-pressing plate 8.

Specifically, a screw groove 71*a* is threadedly formed in the inner surface of the small-diameter portion 71 of the spring-receiving chamber 7', and a bolt-shaped spring end support member 91 is threaded into the screw groove 71*a* from above the small-diameter portion 71.

A coiled spring 92 in the form of a spring member is disposed between the upper surface of the pressure receiving portion 81 of the center-pressing plate 8 and the lower surface of the spring end support member 91 in such a manner that the central portion of the block 110 is pressed by the center-pressing plate 8 which is biased by the coiled spring 92.

The urging force applied to the block 110 by the center-pressing plate 8 is adjusted by moving the spring end support member 91 into or out of the spring-receiving chamber 71.

That is, the biasing force of the coiled spring 92 can be increased by screwing the spring end support member 91 into the small-diameter portion 71 to thereby reduce the amount of depth of the small-diameter portion 71.

On the contrary, the biasing force of the coiled spring 92 can be reduced by screwing out the spring end support member 91 from the small-diameter portion 71 to thereby increase the amount of depth of the small-diameter portion 71.

Since the other construction and operation of this embodiment are similar to the above-mentioned first embodiment, a detailed description thereof is omitted here.

The Third Embodiment

Figure 9:
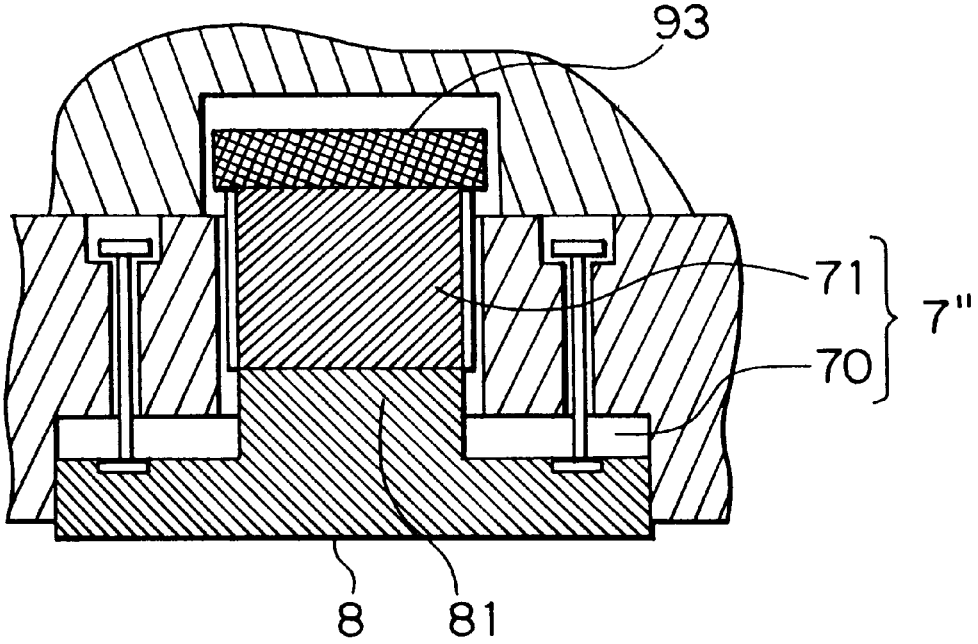
FIG. 9 is a sectional view showing essential parts of a third embodiment of the present invention.
Figure 10:
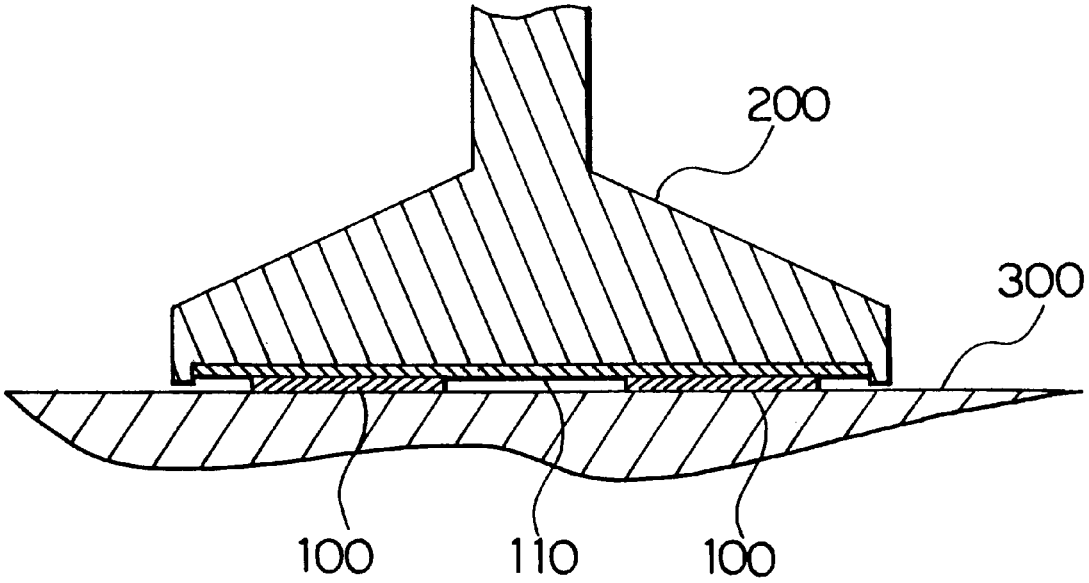
FIG. 10 is a schematic cross section showing a wafer planarizing operation with a conventional one-side surface lapping apparatus.
Figure 11A:
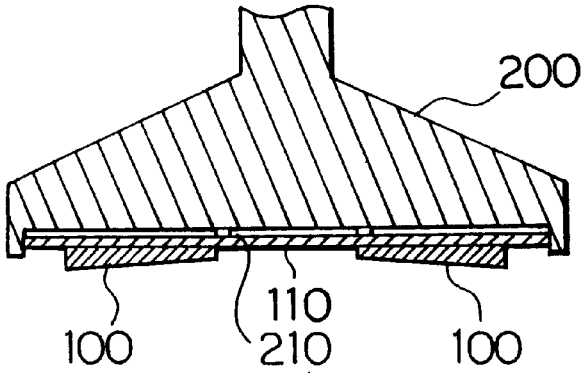
FIGS. 11(*a*) through 11(*c*) are schematic cross sections for explaining a conventional wafer planarizing technique.
Figure 11B:
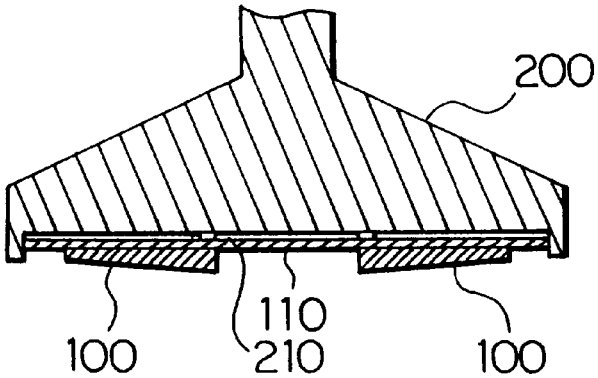
Figure 11C:
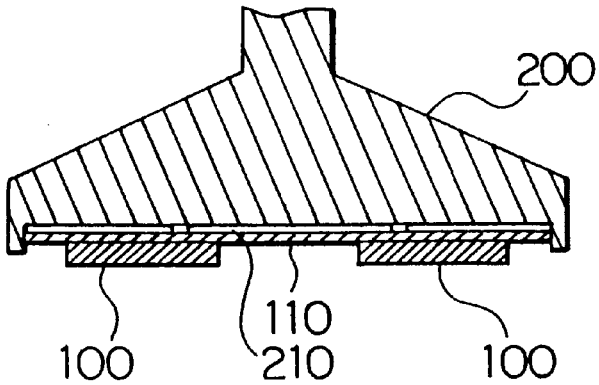

FIG. 9 shows in cross section essential parts of a third embodiment of the present invention.

This embodiment is different from the above-mentioned first and second embodiments in that the spring-receiving chamber 7' in the second above-mentioned embodiment is used as a female screw portion 7", and that the center-pressing plate 8 is pressed by a male screw portion 93.

The urging force of the center-pressing plate 8 applied to the block 110 is adjusted by an amount of threading of the male screw portion 93 which is defined by abutting an end of the male screw portion 93, which is threaded into the small-diameter portion 71 of the female screw portion 7" from above, against the upper surface of the pressure-receiving portion 81 of the center-pressing plate 8.

Since the other construction and operation of this embodiment are similar to the above-mentioned first and second embodiments, a detailed description thereof is omitted.

Moreover, the present invention is not limited to the above-mentioned embodiments, but it can be changed or modified in various ways within the spirit and scope of the invention as defined in the appended claims.

For instance, although in the above-mentioned embodiments, the present invention has been applied to a one-side surface lapping apparatus, the present invention can also be applied to other various apparatuses such as a one-side surface polishing apparatus, etc., in which a one-side surface of a work is polished while being pressed against a surface plate by means of a pressure member through a block.

Furthermore, the center-pressing plate 8 is pressed under the action of air pressure in the above-mentioned first embodiment, but the present invention is not limited to this but can instead be constructed such that the center-pressing plate 8 is pressed or pushed by the pressure of various kinds of fluid such as hydraulic pressure.

Still further, the coiled spring 92 has been used as a spring member in the above-mentioned second embodiment but various kinds of spring members such as a leaf spring, etc. can of course be utilized in place of the coiled spring 92.

As described above in detail, according to the present invention, since the peripheral portion of a block can be pressed by a pressure member through a ring and the central portion of the block can be pressed by the center-pressing means, the distribution of an urging force applied to a work can automatically be controlled by adjusting an urging force applied to the central portion of the block by the center-pressing means.

As a result, the operations of detaching a used ring and of preparing a new one are not required, thus providing an excellent advantage that pressure adjustment can be effected in a simple and easy manner in a short period of time.

Moreover, since it is possible to use the ring almost permanently without detaching it, there is obtained another advantage that the wastefulness in throwing away a used ring can be avoided.

What is claimed is:

1. A work planarizing method comprising the steps of:

attaching works to a lower surface of a planar block; disposing an annular ring to encircle said works in a peripheral portion of said block;

contacting works attached to a lower surface of a planar block to a surface plate;

providing an adjustable central pressing member and outer peripheral pressing member to said block;

planarizing the surfaces of said works by rotating said surface plate while pressing the peripheral portion of said block by means of said outer peripheral pressure member through said ring and concurrently pressing said central portion of said block by said adjustable central pressure member so as to correct irregularities in the distribution of the urging force applied between an outer peripheral portion and an inner peripheral portion of each of said works, thereby applying uniform urging force to each of said works.

2. A work planarizing apparatus comprising:

a surface plate adapted to rotate for planarizing works;

a planar block having an annular ring for enclosing a plurality of works attached to a lower surface of said planar block for the purpose of planarizing said works;

a central pressure member for holding the planar block having said works attached to a lower surface thereof so as to press said works toward said surface plate;

an outer peripheral pressure member for pressing the outer peripheral surfaces of said works towards said surface plate concurrently with said central pressure member;

the annular ring provided in a peripheral portion of said block so as to encircle said works; and adjustable central pressing member for pressing a central portion of said block at a desired pressure so as to correct irregularities in the distribution of the urging force applied between an outer peripheral portion and an inner peripheral portion of each of said works, thereby applying uniform urging force to each of said works.

3. The work planarizing apparatus as set forth in claim 2, wherein said center-pressing means comprises:

a pressure chamber defined in said pressure member at a central portion of a surface thereof;

a pressing member received in an opening of said pressure chamber so as to be movable into or out of said opening so that it can project from said opening of said pressure chamber to thereby press a central portion of said second surface of said block; and a pressure control member for controlling a pressure of fluid in said pressure chamber.

4. The work planarizing apparatus as set forth in claim 3, wherein said fluid is air.

5. The work planarizing apparatus as set forth in claim 2, wherein said center-pressing means comprises:

a spring-receiving chamber which opens substantially at a central portion of the first surface of said pressure member;

a spring-end support member provided in said spring-receiving chamber so as to be movable therein to adjust an amount of depth of said spring-receiving chamber; and a pressing member disposed at said opening of said spring-receiving chamber in such a manner as to move in or out of said opening; a spring member for biasing said pressing member to project from said opening.

6. The work planarizing apparatus as set forth in claim 2, wherein said center-pressing means comprises:

a female screw portion disposed substantially at the central portion of said pressure member; and a male screw portion threaded into said female screw portion so as to project from said female screw portion for pressing the second surface central portion of said block.

7. The work planarizing apparatus as set forth in claim 2, and further comprising guide rods mounted on said center-pressing means to restrict movement of said center-pressing means.

8. The work planarizing apparatus as set forth in claim 7, wherein there are three guide rods mounted on said center-pressing means, said rods being equidistantly spaced to restrict movement of said center-pressing means.

9. The work planarizing apparatus as set forth in claim 2, wherein said block is adapted to rotate.

10. The work planarizing apparatus as set forth in claim 3, wherein:

said pressure chamber comprises a large-diameter portion and a small-diameter portion; and said pressing member comprises:

a block-pressing portion having a diameter substantially equal to said large-diameter portion, said block-pressing portion airtightly fitted in said large-diameter portion; and a pressure-receiving portion having a diameter substantially equal to said small-diameter portion, said pressure-receiving portion airtightly fitted in said small-diameter portion.

11. The work planarizing apparatus as set forth in claim 10, and further comprising guide rods mounted on the upper surface of said block-pressing portion to restrict movement of said pressing member.

12. The work planarizing apparatus as set forth in claim 5, wherein:

said spring-receiving chamber comprises a large-diameter portion and a small-diameter portion; and said pressing member comprises:

a block-pressing portion having a diameter substantially equal to said large-diameter portion, said block-pressing portion airtightly fitted in said large-diameter portion; and a pressure-receiving portion having a diameter substantially equal to said small-diameter portion, said pressure-receiving portion airtightly fitted in said small-diameter portion.

13. The work planarizing apparatus as set forth in claim 12, and further comprising guide rods mounted on the upper surface of said block-pressing portion to restrict movement of said pressing member.

14. The work planarizing apparatus as set forth in claim 6, and further comprising a pressing member received in an opening of said female screw portion in such a manner as to move in or out of said opening, said male screw portion abutting an upper surface of said pressing member.

15. The work planarizing apparatus as set forth in claim 14, wherein:

said female screw portion comprises a large-diameter portion and a small-diameter portion; and said pressing member comprises:

a block-pressing portion having a diameter substantially equal to said large-diameter portion, said block-pressing portion airtightly fitted in said large-diameter portion; and a pressure-receiving portion having a diameter substantially equal to said small-diameter portion, said pressure-receiving portion airtightly fitted in said small-diameter portion.

16. The work planarizing apparatus as set forth in claim 15, and further comprising guide rods mounted on the upper surface of said block-pressing portion to restrict movement of said pressing member.

* * * * *